US006367169B1

(12) United States Patent
Barret

(10) Patent No.: US 6,367,169 B1
(45) **Date of Patent: *Apr. 9, 2002**

(54) SHOE HAVING AN AT LEAST PARTIALLY ELASTIC LINING AND VOLUME ADJUSTING SYSTEM

(75) Inventor: Thierry Barret, Choisy (FR)

(73) Assignee: Salomon S.A., Metz-Tessy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/306,396

(22) Filed: May 6, 1999

Related U.S. Application Data

(63) Continuation of application No. 08/665,892, filed on Jun. 19, 1996.

(30) Foreign Application Priority Data

Jun. 30, 1995 (FR) ..... 95 08084

(51) Int. Cl.[7] ..... A43B 11/00; A43B 23/00; A43B 23/07; A43B 23/26; A43C 11/00

(52) U.S. Cl. ..... 36/51; 36/50.1; 36/54; 36/55; 36/45

(58) Field of Search ..... 36/45, 51, 54, 36/55, 50.1

(56) References Cited

U.S. PATENT DOCUMENTS

| | | | | | |
|---|---|---|---|---|---|
| 145,117 | A | * | 12/1873 | Mitchell | 36/51 |
| 770,822 | A | * | 9/1904 | Rooney | 36/54 |
| 2,147,197 | A | | 2/1939 | Glidden | 36/9 |
| 4,736,531 | A | | 4/1988 | Richard | 36/114 |
| 5,337,493 | A | * | 8/1994 | Hill | 36/54 |
| 5,345,697 | A | | 9/1994 | Quellais | 36/50.1 |
| 5,392,535 | A | | 2/1995 | Van Noy et al. | 36/50.1 X |
| 5,416,987 | A | * | 5/1995 | Bermis et al. | 36/54 X |
| 5,471,769 | A | | 12/1995 | Sink | 36/50.1 |
| 5,533,279 | A | | 7/1996 | Mitsui et al. | 36/55 X |
| 5,537,763 | A | | 7/1996 | Donnadieu et al. | 36/50.5 X |
| 5,566,474 | A | | 10/1996 | Leick et al. | 36/50.5 X |
| 5,566,475 | A | * | 10/1996 | Donnadieu | 36/55 |
| 5,647,104 | A | | 7/1997 | James | 36/50.1 X |
| 5,704,138 | A | * | 1/1998 | Donnadieu | 36/58.5 |
| 5,829,169 | A | * | 11/1998 | James | 36/50.1 |
| 5,940,990 | A | * | 8/1999 | Barret | 36/55 |

FOREIGN PATENT DOCUMENTS

| | | | | |
|---|---|---|---|---|
| EP | 0109384 | | 5/1984 | |
| EP | 0287358 | | 10/1988 | |
| EP | 0521287 | | 1/1993 | |
| EP | 0651953 | | 5/1995 | |
| FR | 2678487 | * | 1/1993 | 36/58.5 |
| FR | 2711896 | * | 5/1995 | 36/55 |

* cited by examiner

*Primary Examiner*—Anthony Stashick
(74) *Attorney, Agent, or Firm*—Greenblum & Bernstein P.L.C.

(57) ABSTRACT

A shoe of the type that includes an upper, an external sole, and a lining at least partially elastic arranged inside of the shoe. The elastic lining defines, at rest, a volume that corresponds at least to that of the largest foot adapted to be received in the shoe, and includes an arrangement for adjusting its volume to adapt it to the real volume of the foot placed inside the shoe. Advantageously, the volume adjustment arrangement is constituted by a double row of guides facing one another in a limited area of the elastic lining and spaced apart by a value corresponding substantially to the maximum difference in the volume of the foot, and by a lace passing through the guides and associated with a traction and blocking device for the lace.

46 Claims, 5 Drawing Sheets

SHOE HAVING AN AT LEAST PARTIALLY ELASTIC LINING AND VOLUME ADJUSTING SYSTEM

CROSS-REFERENCE TO RELATED APPLICATIONS

This application is a continuation of application Ser. No. 08/665,892, filed on Jun. 19, 1996, the disclosure of which is hereby incorporated by reference thereto in its entirety and the priority of which is claimed under 35 USC 120.

This application is also based upon French application No. 95.08084, filed on Jun. 30, 1995, the disclosure of which is hereby incorporated by reference thereto in its entirety and priority of which is hereby claimed under 35 USC 119.

BACKGROUND OF THE INVENTION

1. Field of the Invention

The present invention relates to a shoe adapted more particularly for the practice of a sport, the shoe being of the type that includes an upper and an external sole, as well as a lining, at least partially elastic, arranged inside of the upper.

2. Description of Background and Relevant Information

The use of such elastic linings, especially in sport shoes, is increasingly favored for the proprioceptive qualities which they provide.

For example, U.S. Pat. No. 2,147,197, filed in 1936, describes a sport shoe constituted of a jersey sock anchored through its end on the sole, and of an external upper partially surrounding the sock and fixed on the sole in a manner that is totally independent of the sock, the knitted structure of the sock providing the latter with a certain elasticity.

U.S. Pat. No. 4,736,531, filed in 1987, describes a sport shoe, adapted more particularly to aerobics, which includes a kind of internal half-sock completely surrounding the fore-foot, and whose end is anchored on the external sole, the sock being free to "grip" the foot independently of the external upper.

In this case, the sock is made out an extensible material such as that known under the commercial name Spandex, which, unlike U.S. Pat. No. 2,147,197, actually enables the sock to tightly envelop the foot and to follow the movements thereof.

Different constructions of sport shoes have likewise been proposed by French Patent Publication No. 2 711 896, such shoes being more particularly adapted for cross country skiing, and incorporating a lining made of an elastic material arranged inside an upper, in order to increase the sensations of the foot and of the ankle, and to locate, in an accurate manner, the respective space positions of such sensations that are indispensable to obtain a good precision of movement.

In fact, the type of shoe known from these two patent documents uses the proprioceptive qualities of certain parts of the foot and of the ankle.

To obtain an optimum response, it is necessary that the elastic lining tightly envelop the foot and the ankle by constituting a kind of second skin, regardless of the foot inserted inside the shoe.

Such an elastic lining must therefore be configured so as to define, at rest, a volume slightly less than the volume of the foot which it is adapted to receive, so as to exert a slight regular pressure thereon, without any excessive tightening.

In practice, these elastic linings are therefore designed with a volume slightly less than the volume of the narrowest foot that can be placed inside the shoe.

As a result, difficulties arise when putting on the shoe, especially for larger feet, these difficulties being more substantial as the elastic lining "rises" higher on the ankle as in the case of the sport shoes featured in French Patent Publication No. 2 711 896.

It has been provided in the above-identified French Patent Publication No. 2 711 896 to provide the elastic lining with a slit allowing for the positioning of the foot and being capable of being closed by self-gripping means.

However, such a construction does not allow for an accurate adjustment and adaptation of the volume of the sock or elastic lining to the volume of the foot.

Moreover, this construction with an opening slit is not compatible with the use of a high closed upper which only provides a very limited access to the inside of the shoe, such access being insufficient to easily open and close the slit of the lining.

One can also provide that the volume of the elastic lining correspond to that of an average foot to be place inside of the shoe. In this case, the problem of inserting large feet in the shoe remains, whereas a narrow foot no longer benefits from the tight enveloping of the elastic lining.

Finally, it is also advisable to be able to maintain a completely closed elastic lining structure, especially for reasons related to the imperviousness.

SUMMARY OF THE INVENTION

Therefore, an object of the invention is to overcome these disadvantages, and to provide a construction for a shoe with an improved elastic lining that reconciles the opposing problems related to an easy insertion of the foot, accurate adaptation to the volume thereof, and imperviousness.

An object of the present invention is also to improve the comfort aspects and proprioceptive sensations of such a shoe.

This object is achieved in the shoe according to the invention that is of the type constituted of an upper, an external sole, and a lining at least partially elastic arranged inside of the shoe, by the fact that the elastic lining defines, at rest, a volume that corresponds at least to that of the largest foot adapted to be received in the shoe, and that it includes means for adjusting its volume in view of an adaptation thereof to the real volume of the foot placed inside the shoe.

Such a construction makes it possible to maintain a completely close elastic lining, while allowing for an easy positioning of the foot due to the larger volume of this lining, and offering a possibility of accurate adaptation to each foot and, therefore, greater proprioceptive qualities.

According to an advantageous embodiment, the volume adjustment means are constituted by a double row of guides facing one another in a limited area of the elastic lining and spaced apart of/by a value corresponding substantially to the maximum difference in the volume of the foot, and by a loop through lace passing through the guides and associated with a traction and blocking means of this lace.

Thus, it suffices to exert a traction on the loop of the lace to bring the two rows of guides close together and to block this loop in the desired position in order to reduce the volume of the elastic lining to the desired value.

According to another aspect of the invention, the shoe is provided with a tongue that is elastically biased by the elastic lining against the user's foot.

With such a construction, the tongue is pressed on the entire top portion of the foot, instep of the user, which makes it possible, on the one hand, to increase the area of the foot that is biased by the elastic lining and, therefore, to increase the proprioceptive sensations and information received by the foot and, on the other hand, to distribute, by means of the tongue serving as a pressure distribution plate, all of the elastic pressure exerted by the elastic lining over the entire portion of the foot being in contact with the tongue, i.e., both the top of the foot and the front tibial portion and, therefore, to obtain a more homogeneous and more comfortable distribution of pressure for the foot.

Such an embodiment is particularly interesting in the case of mountain or safety shoes provided with a relatively rigid external upper and equally relatively rigid tongue. Due to its relative rigidity, the tongue is entirely pressed on the corresponding portions of the foot and of the ankle.

BRIEF DESCRIPTION OF THE DRAWINGS

The invention will be better understood and other characteristics will become apparent upon reading the description that follows, with reference to the annexed schematic drawings, illustrating certain preferred embodiments, and in which.

DETAILED DESCRIPTION OF THE INVENTION

Figure 1:
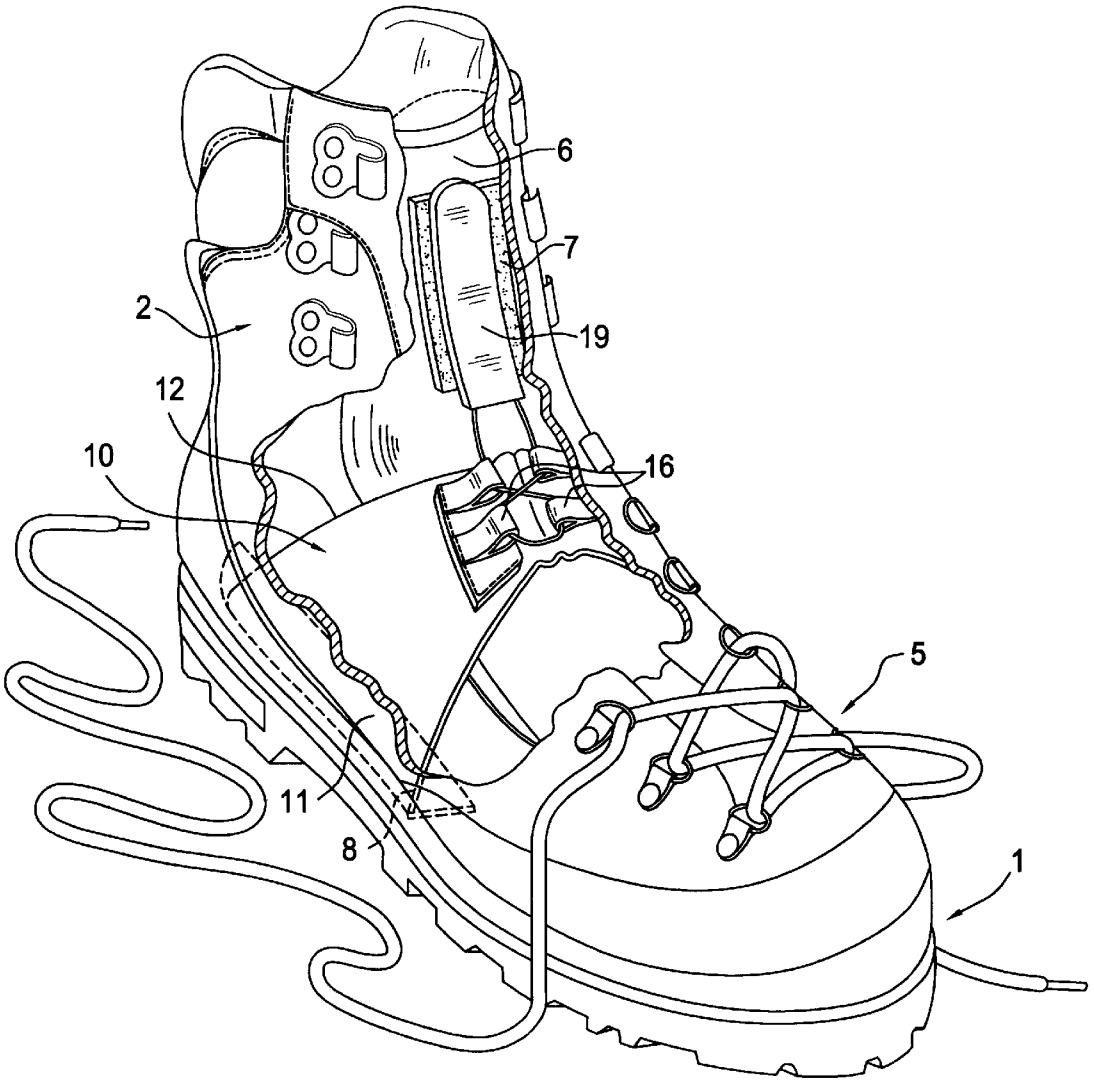
FIG. 1 is three-quarter perspective front view with partial cut-away of a shoe incorporating invention.
Figure 2:
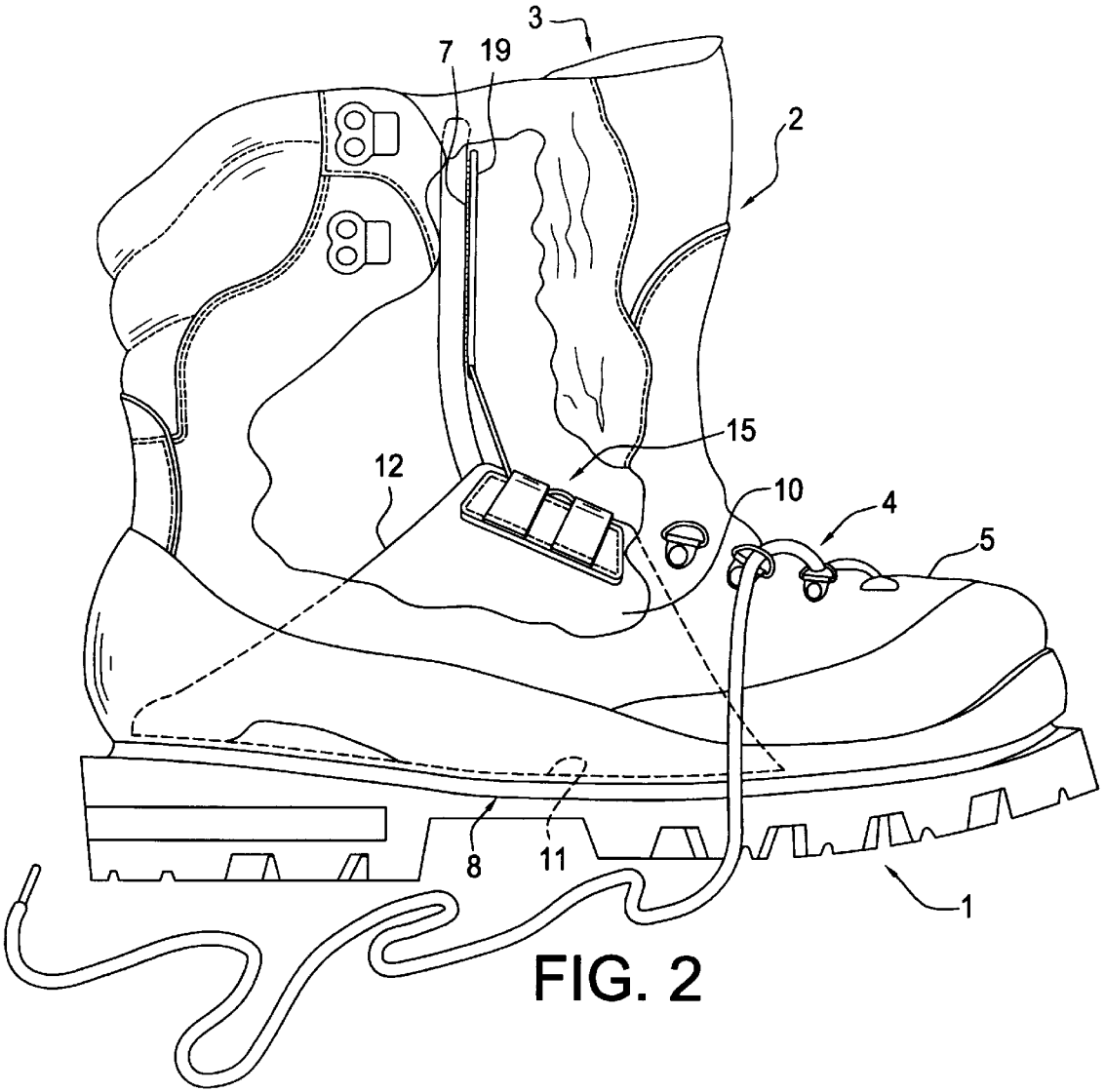
FIG. 2 is a side view of FIG. 2 with partial cut-away.

FIGS. 1 and 2 show the application of the invention to a sport shoe of the walking/mountain type.

Such a shoe is constituted, in a known manner, of a walking sole 1 topped by an external upper 2, so-called high upper because it extends beyond the ankle journal.

As shown more particularly in FIG. 2, the upper 2 has a single opening 3 arranged only at its upper end, and has the shape of a "wide" shoe that can be tightened around the foot and leg by means of a lacing 4 extending on the top of the foot, from the tip 5 of the shoe up to the opening 3 of the upper 2, thereby constituting an example of an external tightening system.

The shoe further includes, within the upper 2, a tongue 6 of a known type provided, on its upper surface, with an attachment means, such as a self-gripping means 7, and whose role will be explained subsequently, and a lining 10 at least partially elastic.

In the example shown in FIGS. 1 and 2, the elastic lining 10 is constituted by a semi-circular band made of an elastic material extending continuously over the instep portion of the shoe while passing above the tongue 6, and fixed in a known manner to the upper 2 and to the external sole 1 through each of its lower ends 11 in the zone 8 for assembling the upper and the sole, and commonly referred to as the "lasting allowance".

The elastic lining 10 could also be fixed through its lower ends 11 only to the upper 2, possibly at different levels of the height of the upper in order to obtain differentiated tightening effects.

It is to be noted the rear edge 12 of the elastic lining 10 extends up to the heel area of the shoe to obtain sensations that extend from the instep to the heel.

Figure 3:
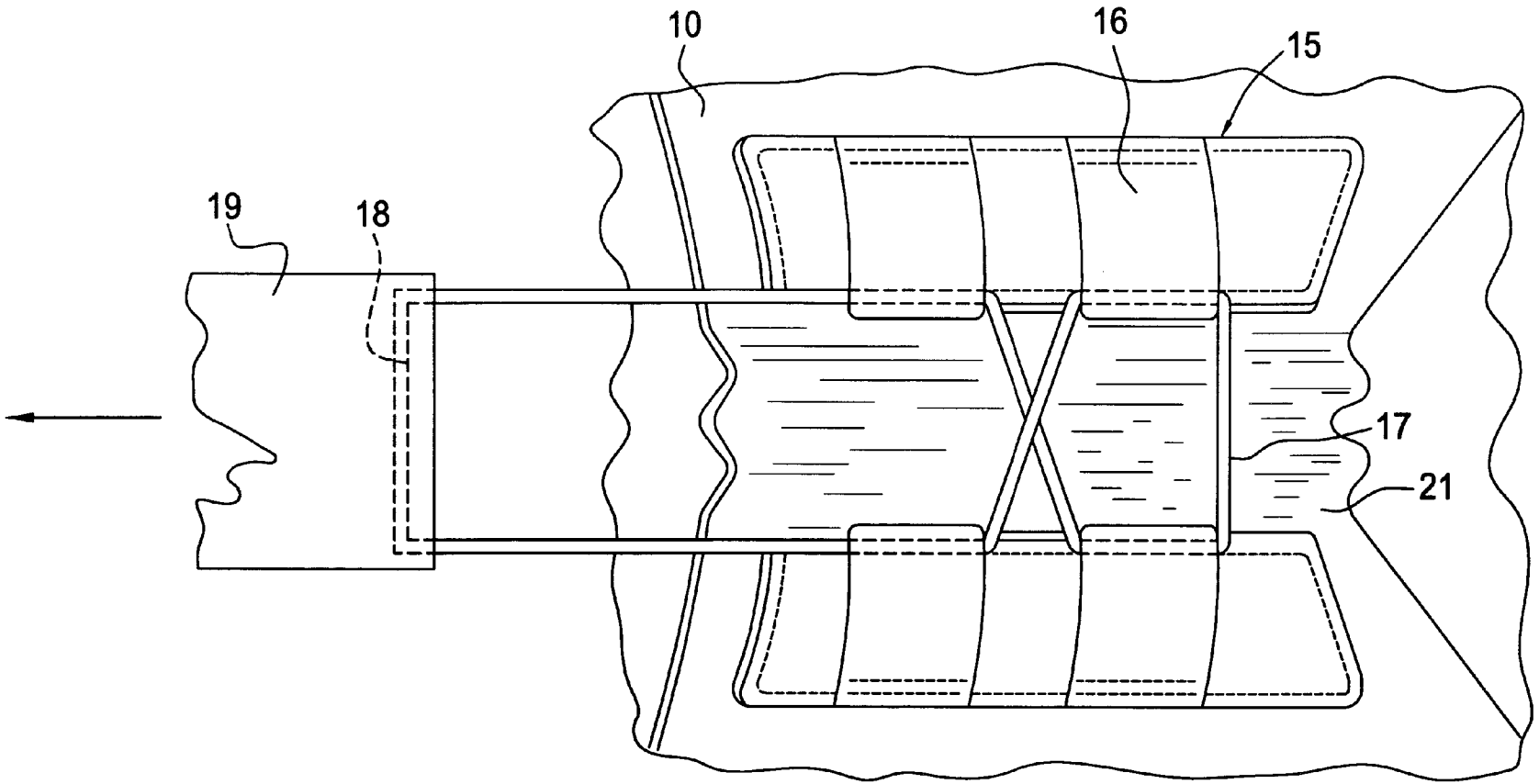
FIG. 3 shows; in a top view, a constructional detail of FIG. 2.

As shown more particularly in FIGS. 1 and 3, the elastic lining 10 defines, at rest, a volume at least equal to that of the largest volume of the foot to be received in the shoe, and includes, on its instep top portion, means 15 for adjusting its volume.

These adjustment means 15 are constituted by a double row of guides 16 and a lace 17 cooperating with the guides 16, the latter being arranged on the elastic lining 10 substantially along the longitudinal axis of the shoe and mutually spaced apart by a value corresponding substantially to the maximum difference between the volumes of the foot that can be received in the shoe.

In other words, the spacing of these two rows of guides 16 is such that the volume defined between the elastic lining and the bottom of the shoe at rest, i.e., without the guides coming close together, corresponds to the maximum volume of the foot that can be received, whereas the volume defined by this lining the tightened state, i.e., when the guides 16 are brought close together to the maximum by the lace 17, corresponds to the minimum volume of the foot that can be received. As shown more particularly in FIG. 3, the lace 17 forms a closed loop whose free end 18 is provided with a lug or tab 19 provide on its lower surface with an attachment or self-gripping means, complementary to the self-gripping means 7 of the tongue 6, to allow for a hooking of the latter on the lug 19.

The functioning of the assembly is very simple. Initially, for the positioning of the foot inside the shoe, the lug 19 is manually detached from the tongue 6 and the guides 16 of the elastic lining 10 are spaced apart to the maximum so as to release a maximum volume for the elastic lining. Thus, the insertion of the foot inside the shoe can done without any problem, even for a "large" foot, i.e., a foot having a large instep, the opening delimited by the rear edge 12 of the elastic lining 10 being capable of being enlarged further, if necessary, by means of the tongue 6 arranged beneath the elastic lining 10 and then serving as a control member.

Once the foot is inside the shoe, it suffices to adjust the contour of the elastic lining 10 to that of the foot by bringing the guides 16 close together by means of a manual traction exerted on the lace 17 by means of the lug 19.

Once the desired adjustment is obtained for the elastic lining 10, it suffices to hook the lug 19 to the desired area on the tongue 6 to maintain the tension of the lace 17 and the volume of the elastic lining at the desired value. The lug 19 is thus designed as an element for applying a traction force to the lace 17 and for blocking the lace in place with respect to the guides 16, after the traction force is applied.

A perfect adaptation of the elastic lining to the contour of the foot actually forming a second skin is obtained in this way and very simply, while preserving the characteristics thereof outside of the adjustment zone constituted by the guides 16 and lace 17.

A better transmission and sensation of the information from the ground are therefore obtained, as well as a better sensation of the spatial position of the foot with respect to the ankle. The closure of the shoe is then completed by a tightening of the external upper around the foot, which is necessary for a good holding thereof.

It is to be noted that the adjustment of the volume of the lining 10 can be accompanied by the formation of slight folds 21 in the are of the adjustment zone, i.e., in the area of the guides 16 and the lace 17. But these folds are in fact not a hinderance:

due to the presence of the tongue 6 inserted between the foot and the lining, and due to the low tension exerted by the elastic lining on the foot.

The tongue 6 has not been particularly described because it is known in itself. In fact, it is a comfort element that is padded and fixed to the upper either at the level of the front end of the lacing 4, or even at the tip of the shoe.

The embodiment of the adjustment system, in the form of flat guides cooperating with a lace, is of particular interest because it offers a particularly flat embodiment, necessary in order to avoid any overpressure or formation of a hard spot on the foot during the tightening of the external upper. Other adjustment means could be envisioned insofar as they do not create any overpressure.

In the case where the external upper is a so-called low upper, i.e., one that does not extend beyond the malleoli, the fixing of the hooking lug 19 of the adjustment means 15 could be done on the exterior of the external upper 2 instead of the tongue 6.

Furthermore, the invention is of particular interest in an application in which a shoe has an upper in the form of a "boot" as shown in FIGS. 1 and 2, due to the reduced opening 3 provided by such a boot which only offers a reduced access to the interior and to the difficulty resulting therefrom for having an internal tightening itself.

Figure 4:
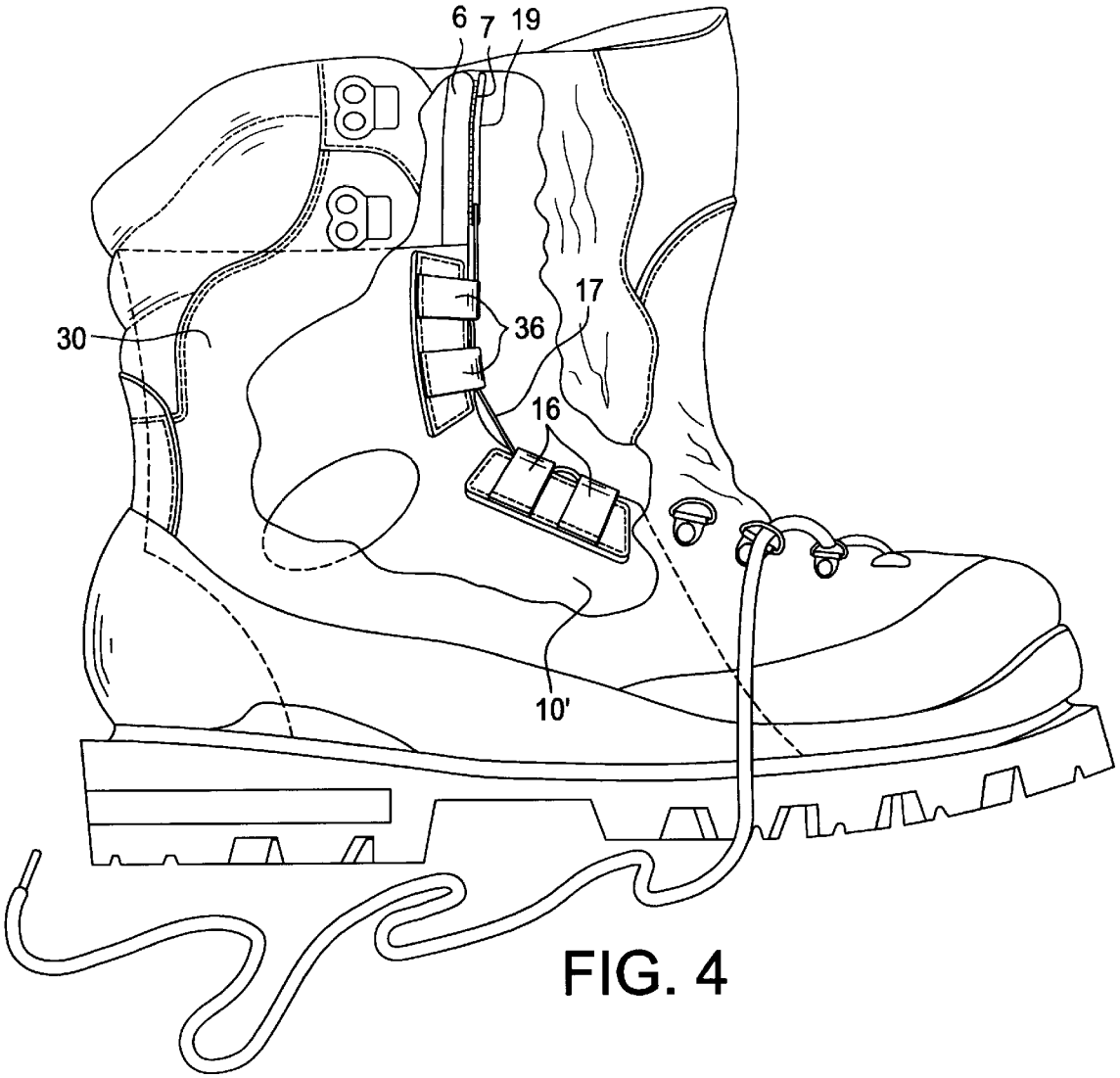
FIG. 4 is a view similar to that of FIG. 2 of a shoe according to a second embodiment.

The embodiment of FIG. 4 distinguishes over that of FIGS. 1 and 2 by a two-part elastic lining, i.e., that includes an instep portion 10' provided with adjustment means 15, similar to that describe in connection with FIGS. 1 and 2, and an ankle portion 30 adapted to surround the user's ankle.

In this case, the ankle portion 30 is likewise designed so as to offer a volume that is at least equal to that of the largest volume of the foot (the term "foot" here encompassing both the foot itself and the ankle) adapted to be received in the shoe, and includes means for adjusting its volume, such means being constituted of a double row of guides 36 and of the lace 17.

In the case shown, the same lace 17 therefore cooperates with the guides 16, 36 for the adjustment of the volume of the two parts of the elastic lining, and becomes attached to the tongue 6 through its lug 19.

It is also possible to provide two distinct laces with different attachment or lacing zones.

Finally, the two parts of the lining 10, 30 can be affixed to one another and form a single piece as shown in FIG. 4, or they can rather be made in several portions with one or several adjusting laces.

Figure 5:
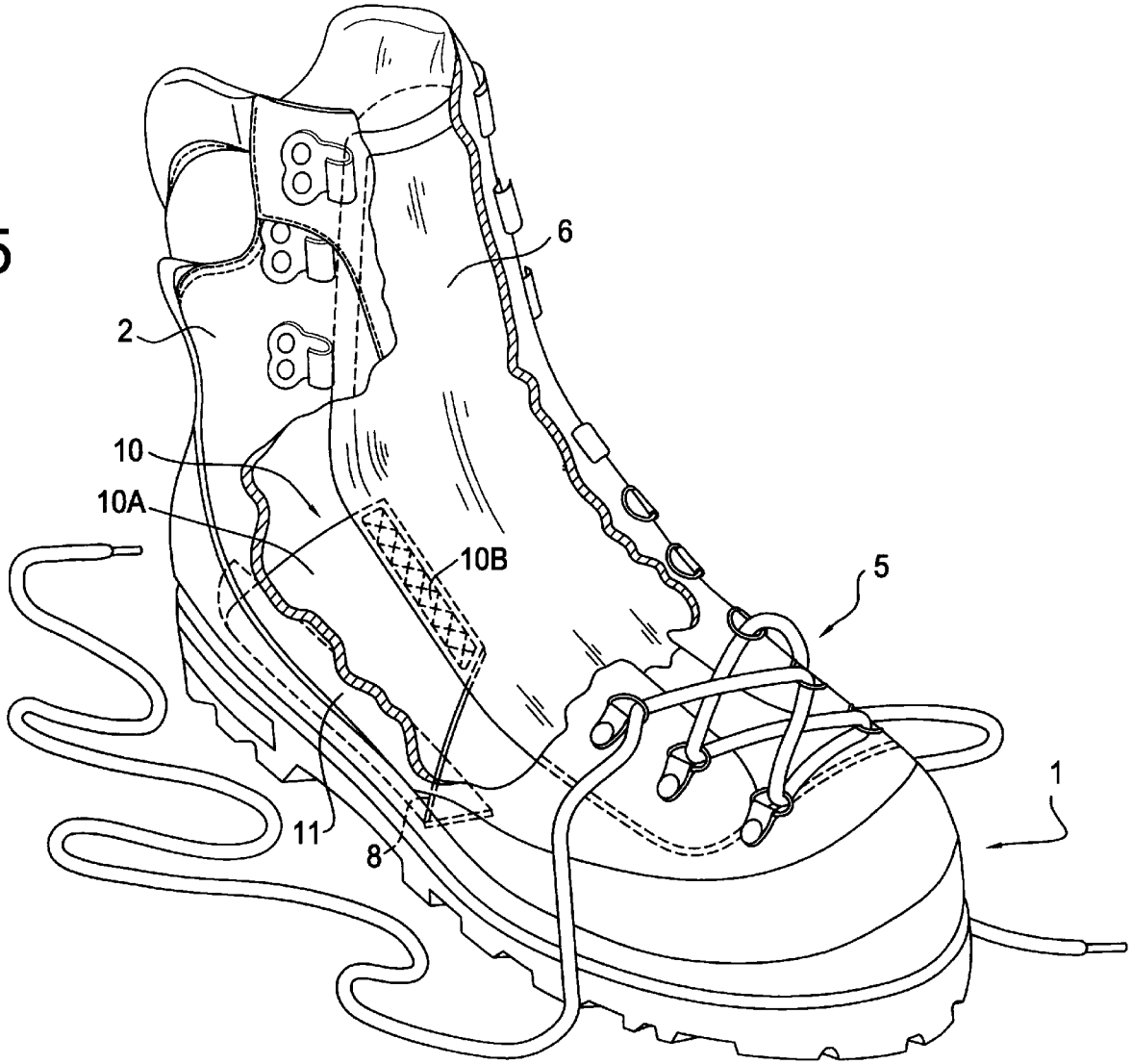
FIG. 5 is a view similar to that of FIG. 2 of a shoe according to a third embodiment.

The embodiment shown in FIG. 5 differs from the two previous embodiments due to the fact that the tongue 6 is assembled directly to the elastic lining portion 10, which reduced in this case to two elastic bands 10*a* arranged on both sides of the tongue, and elastically connecting the latter to the sole. Each elastic band 10*a* is fixed to the tongue 6 through its upper end 10*b*, on the one hand, and through its lower end 11 in the zone 8 for assembling the upper 2 and the sole 2 on the upper itself, on the other hand.

In this embodiment, the elastic lining portion 10 is not provided with means for adjusting its volume, and the volume defined by the tongue and the elastic lining portion is provided so as to adjust to the minimum volume of the foot adapted to be received inside the shoe.

In such an embodiment, the presence of the tongue 6 distributing the pressure makes it possible to avoid any risk of overpressure on the foot, even for a foot with a large volume.

Such a construction is of particular interest and advantageous for mountain or safety shoes, i.e., shoes that are provided with an external upper made of a thick and resistant material, and difficult to adapt in an accurate fashion to the volume of the foot, because it makes it possible to obtain an excellent envelopment of the foot and of the ankle at low cost and, therefore, to increase the proprioceptive sensations and the transmission of information on the spatial positions thereof.

A relative rigidity of the tongue is likewise indispensable in such case to obtain a good distribution of pressure on the zone of the top of the foot, including the ankle, and to avoid the formation of a localized and hindering pressure in the location of the elastics bands load. Moreover, such a relative rigidity of the tongue 6 facilitates the handling of the latter and its opening, as well as of the elastic lining 10 in view of the positioning of the foot. This relative rigidity will be determined so as not to hinder the use of the shoe and, especially walking.

The present invention is not limited to the embodiments described hereinabove by way of non-limiting examples. Thus, the means for attaching the lace could, for example, be constituted by a succession of hooks in which the upper loop of the lace could be engaged.

Likewise, the means for adjusting the volume, and especially the traction and blocking means of the lace, could be obtained in a different manner without leaving the scope of the present invention.

What is claimed is:

1. A shoe comprising:

an external sole;

an external upper affixed to the external sole;

a lining system comprising a lateral lining and a medial lining, the lining system being substantially entirely covered by the external upper;

at least one of the lateral lining and the medial lining being at least partially elastic and adapted to extend at least partially over an instep portion of a foot inserted in the shoe;

an external tightening system arranged on the external upper for changing a volume of the shoe independently of the lining system; and a tongue affixed to the external upper and comprising a lateral side and a medial side;

wherein at least one of the lateral lining and the medial lining is positioned to apply an elastic force downwardly in the instep portion of the foot to the corresponding lateral and medial side of the tongue.

2. The shoe of claim 1, wherein each of the lateral lining and the medial lining is at least partially elastic and wherein each of the lateral lining and the medial lining is adapted to extend at least partially over an instep portion of a foot inserted in the shoe.

3. The shoe of claim 2, wherein each of the lateral lining and the medial lining is positioned to apply an elastic force to the corresponding lateral and medial sides of the tongue.

4. The shoe of claim 1, wherein each of the lateral lining and the medial lining has one end which is affixed to corresponding lateral and medial sides of the tongue.

5. The shoe of claim 4, wherein each of the lateral lining and the medial lining has another end which is affixed to corresponding lateral and medial sides of the sole.

6. The shoe of claim 5, wherein the tongue is adapted to extend in an area over an upper surface of a foot inserted in the shoe.

7. The shoe of claim 6, wherein the tongue is relatively rigid.

8. The shoe of claim 1, wherein the tongue is relatively rigid.

9. The shoe of claim 3, wherein the tongue is relatively rigid.

10. The shoe of claim 1, wherein the external upper is an external high upper which is adapted to extend above an ankle of a foot inserted in the shoe, and wherein the tongue extends from a forward area of the external tightening system to substantially an upper end of the external high upper.

11. A shoe comprising:

an external sole;

an external upper affixed to the external sole;

a lining system comprising a lateral lining and a medial lining, the lining system being entirely covered by the external upper;

each of the lateral lining and the medial lining being at least partially elastic and adapted to extend at least partially over an instep portion of a foot inserted in the shoe;

an external tightening system arranged on the external upper adapted for applying a compressive force to a foot inserted in the shoe independently of the lining system;

a tongue affixed to the external upper and comprising a lateral side and a medial side;

wherein the lateral lining has one end affixed to the lateral side of the tongue and wherein the medial lining has one end affixed to the medial side of the tongue.

12. The shoe of claim 11, wherein the lining system is adapted to force the tongue against a foot inserted in the shoe.

13. The shoe of claim 12, wherein each of the lateral lining and medial lining is positioned to apply an elastic force to the corresponding lateral or medial sides of the tongue.

14. The shoe of claim 13, wherein each of the lateral lining and the medial lining has another end which is affixed to corresponding lateral and medial sides of the sole.

15. The shoe of claim 11, wherein each of the lateral lining and the medial lining has another end which is affixed to corresponding lateral and medial sides of the sole.

16. The shoe of claim 15, wherein the tongue is adapted to extend in an area over an upper surface of a foot inserted in the shoe.

17. The shoe of claim 16, wherein the tongue is relatively rigid.

18. The shoe of claim 11, wherein the tongue is relatively rigid.

19. The shoe of claim 14, wherein the tongue is relatively rigid.

20. The shoe of claim 11, wherein the external upper is an external high upper which is adapted to extend above an ankle of a foot inserted in the shoe, and the tongue extends from a forward area of the external tightening system to substantially an upper end of the external high upper.

21. A shoe comprising:

an external sole;

an external upper affixed to the external sole;

an external tightening system for tightening the external upper;

a lining system which is at least partially directly affixed to the external sole with the external upper on each of a lateral side and a medial side of the sole;

the lining system being at least partially elastic, substantially entirely covered by the external upper, and adapted to extend at least partially over an instep portion of a foot inserted in the shoe; and a tongue affixed to the external upper;

wherein the lining system is independent from the external tightening system and wherein the lining system is adapted to force the tongue against a foot inserted in the shoe.

22. The shoe of claim 21, further comprising a mechanism adapted for adjusting the force exerted by the tongue against a foot inserted in the shoe.

23. The shoe of claim 22, wherein the lining system comprises a substantially unitary lining.

24. The shoe of claim 23, wherein the lining system is at least partially disposed between the tongue and the external high upper.

25. The shoe of claim 21, wherein the lining system comprises a substantially unitary lining.

26. A shoe comprising:

an external sole;

an external upper affixed to the external sole;

an external tightening system for tightening the external upper;

a tongue affixed to the external upper;

a lining system at least partially disposed between the tongue and external upper, the lining system being directly affixed to the sole on each of a lateral side and a medial side of the sole;

the lining system being at least partially elastic and adapted to extend at least partially over the tongue and an instep portion of a foot inserted in the shoe;

wherein the lining system is adapted to apply a compressive force to the tongue and a foot inserted in the shoe and the external tightening system is adapted to apply a compressive force to a foot inserted in the shoe, the lining system operating independently from the external tightening system.

27. The shoe of claim 26, further comprising a mechanism adapted for adjusting the force exerted by the lining system against a foot inserted in the shoe.

28. The shoe of claim 27, wherein the lining system comprises a substantially unitary lining.

29. The shoe of claim 28, wherein the lining system forces the tongue against the foot.

30. The shoe of claim 26, wherein the lining system is adapted to be entirely disposed below an ankle of a foot inserted in the shoe.

31. The shoe of claim 26, wherein the lining system comprises a lateral lining and a medial lining and wherein each of the lateral lining and the medial lining is adapted to extend at least partially over an instep portion of a foot inserted in the shoe.

32. The shoe of claim 31, wherein each of the lateral lining and the medial lining is positioned to apply an elastic force to the corresponding lateral and medial sides of the tongue.

33. The shoe of claim 26, wherein each of the lateral lining and the medial lining has one end which is affixed to corresponding lateral and medial sides of the tongue.

34. The shoe of claim 33, wherein the tongue is adapted to extend in an area over an upper surface of a foot inserted in the shoe.

35. The shoe of claim 34, wherein the tongue is relatively rigid.

36. The shoe of claim 26, wherein the tongue is relatively rigid.

37. The shoe of claim 26, wherein the external upper is an external high upper which is adapted to extend above an ankle of a foot inserted in the shoe, and wherein the tongue extends from a forward area of the external tightening system to substantially an upper end of the external high upper.

38. A shoe comprising:

an external sole;

an external upper affixed to the external sole;

an external tightening system for reducing an internal volume of the shoe, the external tightening system being arranged on the external upper;

a tongue affixed to the external upper adjacent a tip portion of the shoe and which extends freely over an instep portion of a user's foot;

a lining system adapted for forcing the tongue against a user's foot inserted in the shoe, the lining system being directly affixed to both a lateral side and a medial side of the sole; and the lining system being at least partially elastic, at least partially disposed between the tongue and external upper, and adapted to extend at least partially over an instep portion of a user's foot, wherein the lining system is adapted to continuously force the tongue against a user's foot whether or not the external tightening system reduces an internal volume of the shoe.

39. The shoe of claim 38, wherein the lining system is adapted to be substantially disposed below an ankle of a user's foot.

40. The shoe of claim 38, further comprising a mechanism adapted for adjusting the force exerted by the tongue against a user's foot.

41. The shoe of claim 38, wherein the lining system comprises a substantially unitary lining.

42. The shoe of claim 41, further comprising a mechanism adapted for adjusting the force exerted by the tongue against a user's foot.

43. A shoe comprising:

an external sole;

an external upper affixed to the external sole;

a lining system comprising one of a lateral lining and a medial lining, the lining system being substantially entirely positioned within the external upper;

at least one of the lateral lining and the medial lining being at least partially elastic and adapted to extend at least partially over an instep portion of a foot inserted in the shoe;

an external tightening system arranged on the external upper for changing a volume of the shoe independently of the lining system; and a tongue affixed to the external upper and comprising a lateral side and a medial side;

wherein at least one of the lateral lining and the medial lining is positioned to apply an elastic force to the corresponding lateral and medial side of the tongue, and wherein at least one of the lateral lining and the medial lining has one end which is directly affixed to a corresponding lateral and medial side of the sole.

44. The shoe of claim 43, wherein at least one of the lateral lining and the medial lining has another end which is affixed to a corresponding lateral and medial side of the tongue via stitching.

45. The shoe of claim 43, wherein the lining system is adapted to be entirely disposed below an ankle of a foot inserted in the shoe.

46. A shoe comprising:

an external sole;

an external upper affixed to the external sole;

a lining system comprising a lateral lining and a medial lining, the lining system being substantially entirely covered by the external upper;

at least one of the lateral lining and the medial lining being at least partially elastic and adapted to extend at least partially over an instep portion of a foot inserted in the shoe;

an external tightening system arranged on the external upper for changing a volume of the shoe independently of the lining system; and a tongue affixed to the external upper and comprising a lateral side and a medial side, wherein each of the lateral lining and the medial lining is affixed to respective lateral and medial sides of the shoe and extend at least partially over the tongue, and wherein at least one of the lateral lining and the medial lining is positioned to force the tongue against a user's foot.

* * * * *